US007533861B2

(12) United States Patent
Trendelkamp

(10) Patent No.: US 7,533,861 B2
(45) Date of Patent: May 19, 2009

(54) SEAT GUIDE DEVICE

(76) Inventor: Josef Trendelkamp, Emsdettener Strasse 131, 48356 Nordwalde (DE)

( * ) Notice: Subject to any disclaimer, the term of this patent is extended or adjusted under 35 U.S.C. 154(b) by 238 days.

(21) Appl. No.: 11/398,162

(22) Filed: Apr. 4, 2006

(65) Prior Publication Data

US 2006/0219145 A1 Oct. 5, 2006

(30) Foreign Application Priority Data

Apr. 4, 2005 (DE) ..... 20 2005 005 317 U

(51) Int. Cl.
*F16M 13/00* (2006.01)

(52) U.S. Cl. ..... 248/429

(58) Field of Classification Search ..... 248/429, 248/424, 425; 16/67
See application file for complete search history.

(56) References Cited

U.S. PATENT DOCUMENTS 5,816,555 A * 10/1998 Ito et al. ..... 248/429
6,953,178 B2 * 10/2005 Yamada et al. ..... 248/429
7,213,862 B1 * 5/2007 Martin ..... 296/65.13
2008/0048087 A1 * 2/2008 Kojima et al. ..... 248/430

* cited by examiner

*Primary Examiner*—Ramon O Ramirez
(74) *Attorney, Agent, or Firm*—Milde & Hoffberg, LLP

(57) ABSTRACT

A seat guide device has at least one linear guide system and a seat base supported in a movable fashion on the carriage of said system against the force of a spring. The device further comprises:

(a) damping element coupled to at least one of the carriage and the spring, and (b) a block and tackle which includes:

(1) one fixed end which is attached to a stationary attachment point;

(2) one loose end which is connected to the carriage; and (3) one first loose pulley which is connected to a stationary attachment point via the spring.

11 Claims, 4 Drawing Sheets

SEAT GUIDE DEVICE

BACKGROUND OF THE INVENTION

The invention relates to a seat guide device with at least one linear guide system and with a seat base being supported in a movable fashion on the carriage of the system against the force of a spring.

Such seat guide devices are known in particular from the former Bundestag [German Parliament] building in Bonn and the Reichstag [Imperial Diet] building in Berlin. The seats are arranged on and use a support pipe as the seat base, which is supported in a longitudinally movable fashion on the carriage of the linear guide system. In this manner, it is possible to move the seat away from the table, and in so doing giving the spring a tension, which returns the seat base with the seat to its initial position once the user gets up. This automatic return of the seats provides a harmonious arrangement in larger halls and keeps the exit routes behind the seat rows free in that the seats are returned automatically to the initial position; i.e., being guided towards the tables or away from them depending on the installed position.

It has been demonstrated that at greater travel distances, the developed spring tension is so great that the seat with its base is accelerated significantly and hits hard at the stop. Both the mechanical stress and, in particular the associated noise, are undesirable.

SUMMARY OF THE INVENTION

It is, therefore, the objective of the invention to return the seat base of a seat guide device of the aforementioned kind to its initial position in a controlled manner, in particular with a reduced speed compared to the known seat of this type.

This objective, as well as further objectives which will become apparent from the discussion that follows, are achieved, in accordance with the present invention, by providing a damping element, coupled to the carriage and/or the spring, and a block and tackle having at least:

- one fixed end which is attached to a stationary attachment point;
- one loose end which is connected to the carriage; and
- one first loose pulley which is connected to a stationary attachment point via the spring.

Because the carriage and/or the spring are coupled with a damping element, the seat base, which is accelerated by the tension of the spring, is slowed down. By providing a block and tackle, the tensioning path of the spring is reduced at the same time such that, with the same spring constant as with seat guide device known in the art, the displacement of the spring when moving the seat base back, and thus the tensioning forces, can be reduced by half.

In particular, the arrangement of a block and tackle allows for the use of a gas pressure spring through which the spring and the damping element can be combined. Because of the block and tackle, a gas pressure spring with a short design can be employed. This allows for retrofitting of known seat guide devices without the need to change the overall length of the device. Rather, it is possible to integrate the gas pressure spring in the free space between the preferably two parallel linear guides arranged at a prescribed distance to one another underneath the travel of the carriage.

A second block and tackle that operates opposite to the first block and tackle is provided in a preferred embodiment.

This preferred embodiment designed such that, at the second block and tackle, a fixed end is attached to a stationary attachment point, which with regard to the linear guide system is on the opposite side of the stationary attachment point of the first block and tackle, wherein a loose end is connected with the carriage and wherein a second loose pulley of the second block and tackle coincides with the first loose pulley or is arranged with it on the same rotational axis, or exhibits a rotational axis that is positively connected with the rotational axis of the first loose pulley.

This arrangement in particular avoids the problem of slacking cables when the tensioned spring expands and accelerates the carriage together with the seat base and the seat. The second counter-acting block and tackle has the effect that the seat base can move only according to the movement of the first block and tackle, but that the seat base cannot run ahead of the movement of the first block and tackle, or the return pulley of the first block and tackle, respectively. This prevents the cable from coming off the preferably profiled return pulley. The loose pulleys of the first end of the second block and tackle are coupled such that the movement in the first block and tackle leads to a simultaneous counter-movement of equal length in the second block and tackle. The second block and tackle gives way in the amount that the carriage is pulled back to its initial position. Thus, the carriage is positively suspended between the two loose ends of the two block and tackles and can move only proportional to the displacement of the gas pressure spring.

Preferably both block and tackles use a common loose pulley, which is approached from opposite directions. There may also be two separate pulleys provided, which are supported by a common rotational axis. These embodiments save the most design space.

If more design space is available, the loose pulleys of both block and tackles may also be coupled in some other manner, such that the distance of their rotational axes remains unchanged.

Since a seat guide device is typically long and narrow, due to the linear travel, it is advantageous to attach the fixed ends of both block and tackles at opposite sides of the travel and then to provide several return pulleys in order to create the different force attack directions of the two block and tackles.

To affect a space-saving design, it may be provided to attach the loose pulley of the first block and tackle and possibly also of the second block and tackle directly at the tip of the piston rod of the gas spring.

To achieve simple assembly and/or maintenance, it is advantageous to arrange the return pulleys in pulley carrier units, each exhibiting a horizontal axis that stretches perpendicular to the travel. Also provided in the housing are grooves or other recesses perpendicular to the direction of travel, which stretch, when viewed in a cross-section from the side, in a slanted manner down from one top side of the housing and at the same time to the center of the housing. Thus, the pulley carrier units can be installed by simply sliding their horizontal axes into the recesses. The slant in the recesses prevents the pulley carrier units from sliding out on top of the recesses. In this manner, no additional means of attachment are required for the pulley carrier units. The cable paths determine the distance between the horizontal axes of the pulley carrier units through the slant towards the inside and the coupling of the two block and tackles via a common loose pulley and via attachment points at the carriage. Only after loosening one of the loose ends of the block and tackles can the pulley carrier units be pulled apart from each other and thus pulled out of the recesses in the housing.

One preferred embodiment also provides for the gas pressure spring to be coupled directly to one of the pulley carrier units.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
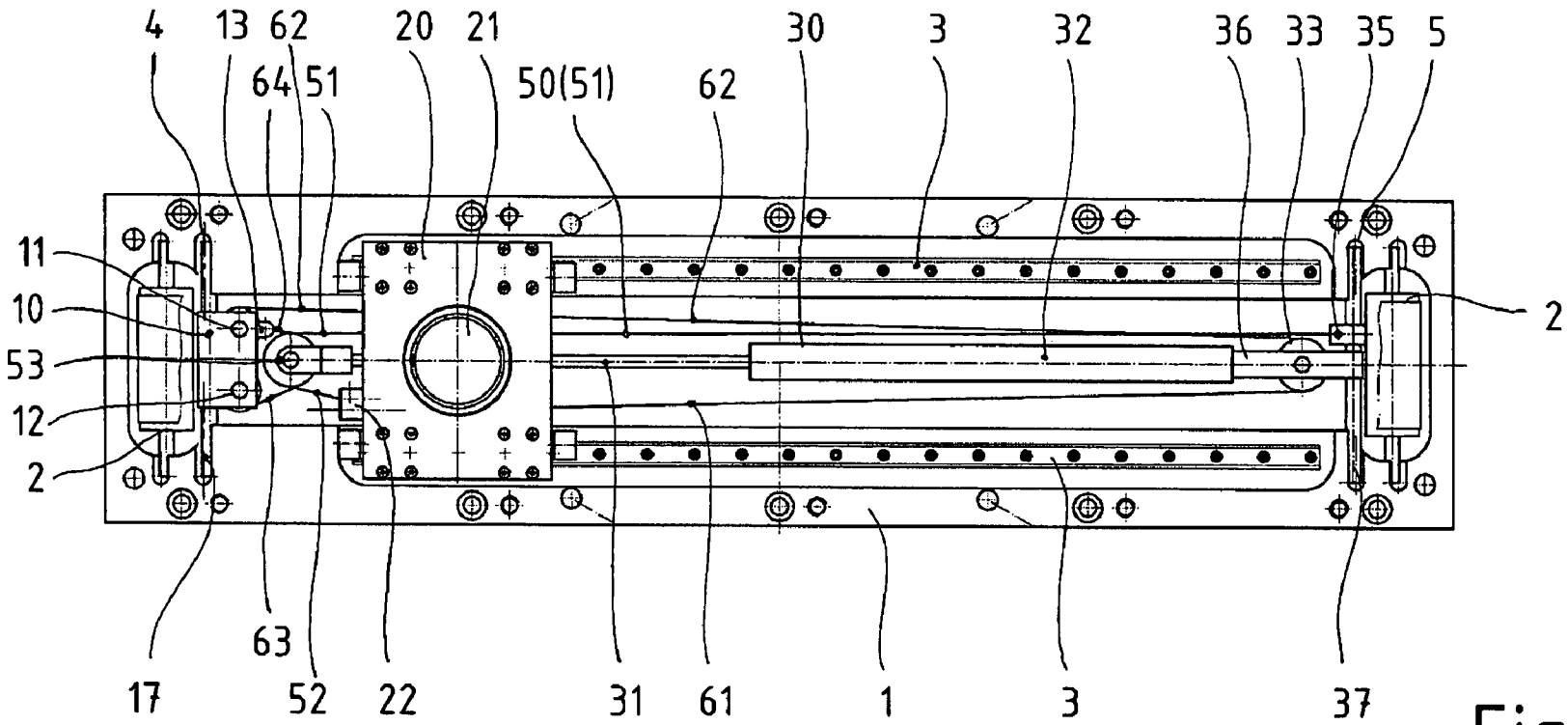
FIG. 1 is a top view of the seat guide device according to the present invention.

The preferred embodiments of the present invention will now be described with reference to FIGS. 1-3*b* of the drawings. Identical elements in the various figures are designated with the same reference numerals.

FIG. 1 shows a seat guide device according to the present invention where all parts are integrated in one housing 1. Two linear guides 3 are located parallel and at a certain distance to one another in a housing 1. The seat base 21 is mounted to the rectangular plate 20, which forms a common carriage for the two linear guides 3.

Pulley carrier units 10, 36 are located to the left and right of the linear guides 3. They each exhibit a horizontal lateral axis 17, 37, which is suspended in corresponding grooves 4, 5 in the housing 1.

The right pulley carrier unit 36 exhibits at its lateral axis 37 an attachment point 35 from which a first cable 50 with its fixed end 51 runs to the return pulley 53 and from there leads as a loose end 52 to an attachment point 22 at the carriage 20.

The left pulley carrier unit 10 incorporates two return pulleys 11, 12 as well as an attachment point 13, where the cable of a second block and tackle is attached. From the attachment point 13 runs the cable 64 to a loose return pulley 53 and continues from there as cable 63 around the return pulleys 11, 12 and then from the left housing side into the interim space between the linear guides 3 to the return pulley 33, which is supported in a rotating manner at the second pulley carrier unit 36. From the pulley 33, the cable then runs with its loose end 61 to the carriage 20, where it is clamped to the attachment point 22.

Through the cable 61, 62, 63, 64, the carriage 20 is held back by a return piston movement from left to right triggered by the gas pressure spring 30 according to the embodiment in FIG. 1.

Return pulleys 2, with a belt running around them, are provided on the face side in the housing. This belt covers the recess in a not shown cover of the housing 1, with the seat base 21 being supported in a movable manner in the recess.

Figure 2:
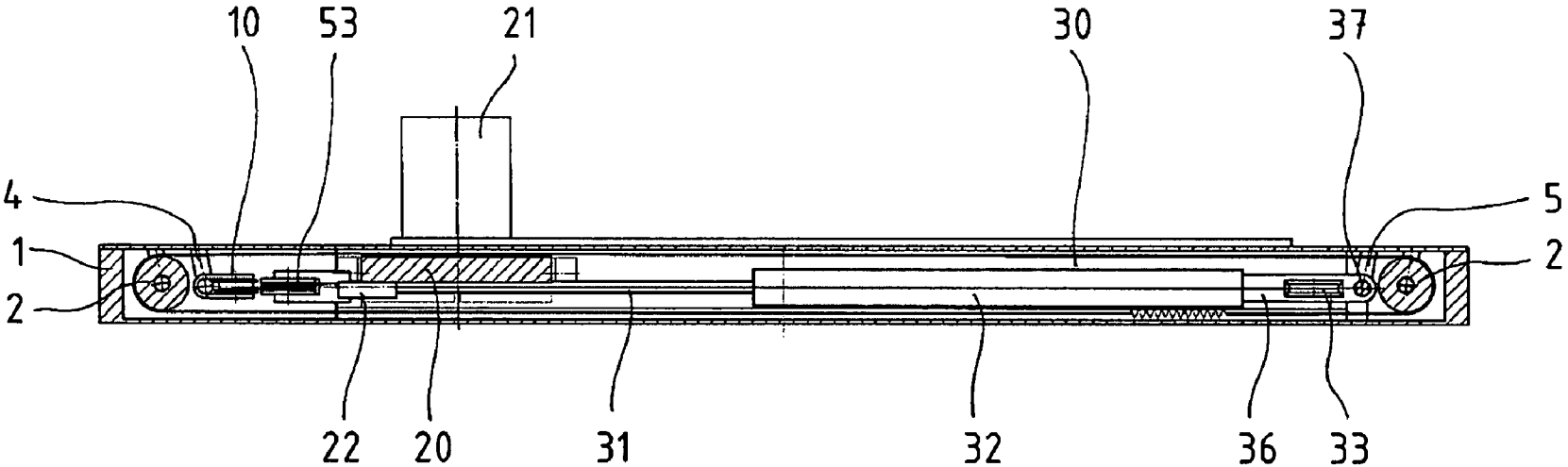
FIG. 2 is a sectional side view of the seat guide device of FIG. 1.

FIG. 2 shows the seat guide device with the same position of the carriage and the seat base 21 in a sectional side view.

In particular, the slanted profile of the recesses 4, 5 for the horizontal lateral axis 17, 37 of the pulley carrier units 10, 36 can be recognized in this drawing. Additionally recognizable is that all cables and pulleys are arranged in one plane, resulting in a particularly flat construction.

Figure 3A:
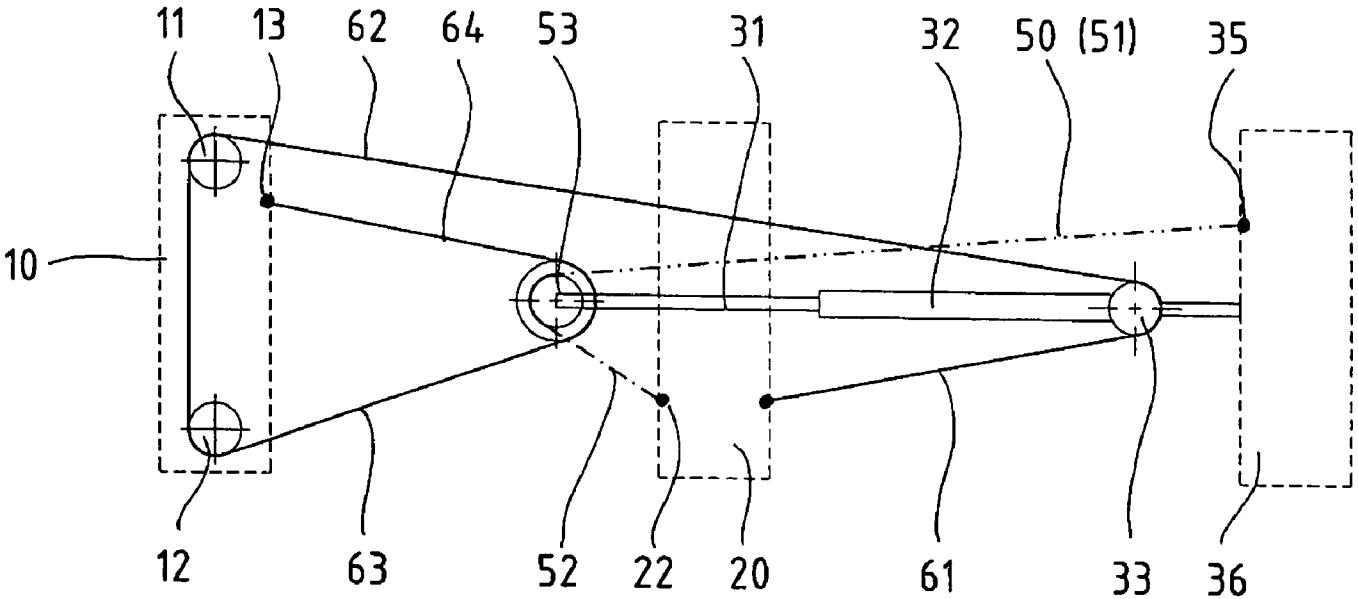
FIG. 3*a* is a schematic presentation, viewed from above, of a first embodiment of the cable path in the seat guide device of FIG. 1.

FIG. 3*a* again schematically shows the cables of the design described previously based on FIGS. 1 and 2 with the two block and tackles. Dashed lines on the left and right indicate the pulley carrier units 10, 36. The carriage 20 is shown in the center.

The first block and tackle is formed by a first cable 50 with its fixed end 51 being attached to the attachment point 35 at the pulley carrier unit 36 and running across the loose pulley 53, and with its free end 52 then returning to the attachment point 22 at the carriage.

If the carriage 20 is moved from left to right, then by the pull at the free end 52, the pulley 53 is pulled to the right causing the piston rod 31 to be pushed into the gas pressure spring cylinder 32 as well. This causes tensioning of the gas pressure spring 30. During the movement of the carriage from left to right under the tension of the gas spring 30, a simultaneous pull is exercised on the second cable via the loose pulley 53. During the pull movement via the cable section 63, the return pulleys 12 and 11, the cable section 62 and the return pulleys 33, the loose end 61, which is also attached to the carriage 20, is pulled, i.e., the second cable is being tensioned.

If the gas pressure spring 30 is now given the opportunity to expand, for example, because the user stands up from the seat, the piston rod 31 pushes into the cable 51, 52 via the pulley 53 and pulls the carriage 20 to the left. To prevent the carriage 20 from running ahead of the cable movement at great acceleration, and to prevent the first cable 50 from coming off the return pulley 53, the carriage 20 is connected to the second cable; i.e., the carriage 20 is held back via the sections 61, 62, 63 of the second cable with the return pulleys 33, 11, 12, 53.

By the fact that both cables use the same loose pulley 53, or at least have pulleys with rotational axes that are in a fixed position to one another, only as much cable can be released on the second cable, which is functioning as the holding cable, as on the first cable due to the return pulley 53 moved by the gas pressure spring cylinder. This presupposes an essentially equal angle of contact at the loose pulley 53. Thus, the different diameters at this pulley shown in FIG. 3*a* serve only the purpose of better presentation and do not constitute a preferred embodiment, because a slip would occur due to different arc lengths of the cables in the contact area of the pulley 53.

Figure 3B:
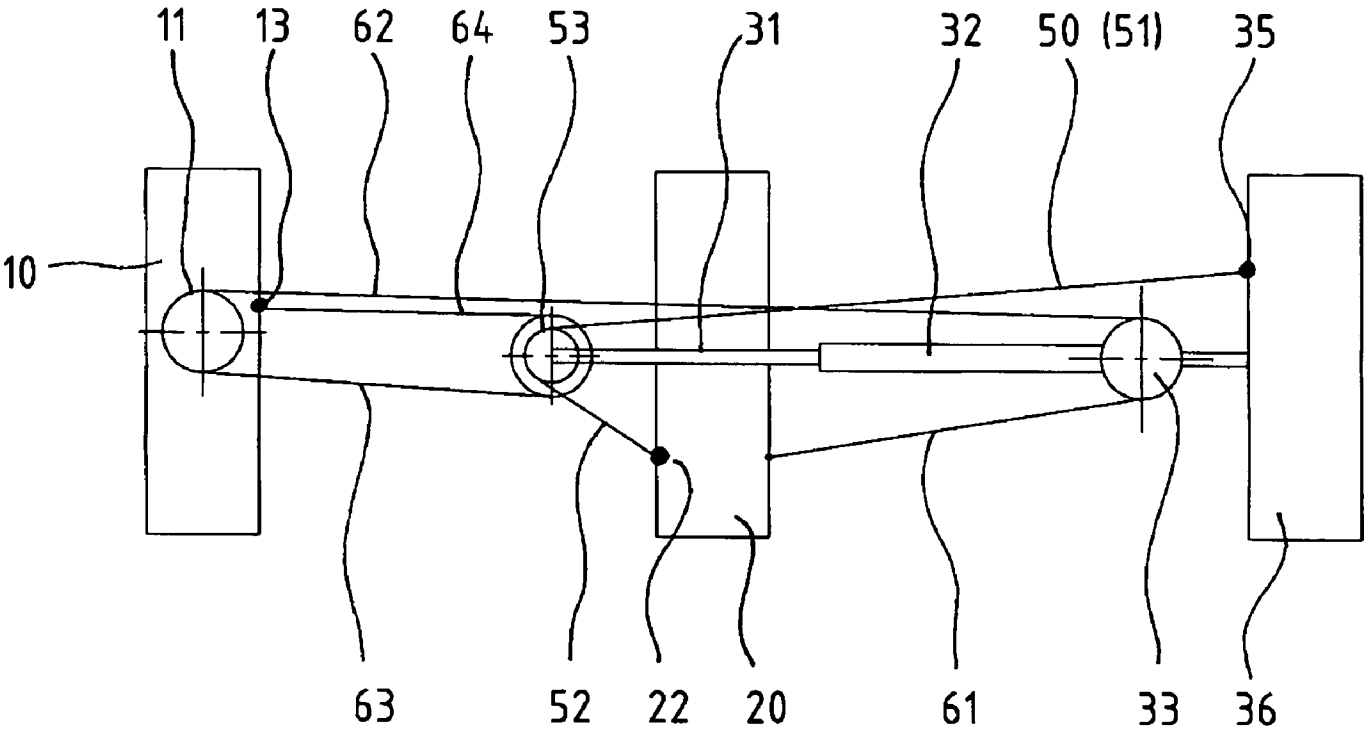
FIG. 3*b* is a schematic presentation, viewed from above, of a second embodiment of the cable path in the seat guide device of FIG. 1.

FIG. 3*b* shows, in a schematic functional form, the cable guides of a slightly modified embodiment, where only one return pulley 11 is provided in the left pulley carrier unit 10. For all other individual components, as well as in its function, the embodiment shown in FIG. 3*b* corresponds to the embodiment shown in FIG. 3*a*. By doing without an additional return pulley in the left pulley carrier unit 10, the design and apparatus investments for the device according to the invention are reduced.

There has thus been shown and described a novel seat guide device which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. In a seat guide device having at least one linear guide system, arranged in a housing, and a seat base supported in a movable fashion on a carriage of said system against the force of a spring, the improvement comprising:

(a) a damping element connected to at least one of the carriage and an attachment point which is stationary relative to the housing; and (b) a first block and tackle having at least:

one fixed end, which is connected to a first attachment point which is stationary relative to the housing;

one movable end, which is connected to the carriage; and one first movable pulley, which is connected to a second attachment point which is stationary relative to the housing via the spring.

2. A seat guide device as set forth in claim 1, further comprising a second block and tackle that operates in opposition to the first block and tackle.

3. A seat guide device as set forth in claim 2, wherein the second block and tackle has a fixed end connected to a third attachment point which is stationary relative to the housing and which in relation to the linear guide is located opposite of the stationary attachment point of the first block and tackle, and a movable end is connected to the carriage, and wherein a second moveable pulley of the second block and tackle is disposed coaxially with the first moveable pulley.

4. A seat guide device as set forth in claim 3, wherein the spring is a gas pressure spring with the first pulley and the second pulley being attached to the piston rod of said gas pressure spring.

5. A seat guide device as set forth in claim 4, wherein the gas pressure spring includes a piston and cylinder which function as both said spring and said damping element.

6. A seat guide device as set forth in claim 2, wherein the second block and tackle is redirected at each end of travel of the carriage by at least one stationary return pulley.

7. A seat guide device as set forth in claim 6, wherein the seat base is supported by two linear guides, which are arranged at a prescribed distance apart in the housing, and wherein the spring, the return pulley and one end of each block and tackle are attached to the housing.

8. A seat guide device as set forth in claim 6, wherein two return pulleys are located in a pulley carrier unit at the side opposite to the spring as viewed in the direction of carriage travel.

9. A seat guide device as set forth in claim 8, wherein the return pulleys are located in pulley carrier units, each having a horizontal axis extending perpendicular to the direction of carriage travel, which can be inserted into recesses in the housing with said recesses extending, when viewed in a cross-section from the side, in a slanted manner down from one top side of the housing and to a center of the housing.

10. A seat guide device as set forth in claim 9, wherein the spring is coupled with one of the pulley carrier units.

11. A seat guide device as set forth in claim 6, wherein one return pulley is located in a pulley carrier unit at the side opposite to the spring as viewed in the direction of carriage travel.

* * * * *